US005333891A

United States Patent [19]

Stritzl et al.

[11] Patent Number: 5,333,891

[45] Date of Patent: Aug. 2, 1994

[54] FRONT JAW

[75] Inventors: Karl Stritzl; Helmut Wladar, both of Vienna; Andreas Janisch, Oeyenhausen; Hubert Wuerthner, Hainburg/Donau, all of Austria

[73] Assignee: HTM Sport- und Freizeitgeraete Aktiengesellschaft, Schwechat, Austria

[21] Appl. No.: 941,137

[22] PCT Filed: Mar. 26, 1992

[86] PCT No.: PCT/EP92/00656

§ 371 Date: Nov. 3, 1992

§ 102(e) Date: Nov. 3, 1992

[87] PCT Pub. No.: WO92/17251

PCT Pub. Date: Oct. 15, 1992

[30] Foreign Application Priority Data

Mar. 28, 1991 [AT] Austria ..... 683/91

[51] Int. Cl.[5] ..... A63C 9/08

[52] U.S. Cl. ..... 280/625; 280/628

[58] Field of Search ..... 280/625, 626, 628, 629, 280/633, 634

[56] References Cited

U.S. PATENT DOCUMENTS 5,033,768 7/1991 Stritzl ..... 280/625
5,044,658 9/1991 Challande et al. ..... 280/634 X
5,149,124 9/1992 Wittman et al. ..... 280/625 X
5,193,841 3/1993 Stritzl et al. ..... 280/628 X
5,257,798 11/1993 Stritzl et al. ..... 280/628 X
5,273,306 12/1993 Wawra ..... 280/625

FOREIGN PATENT DOCUMENTS 0408855 1/1991 European Pat. Off. .
3734492 4/1989 Fed. Rep. of Germany .

*Primary Examiner*—Brian L. Johnson
*Attorney, Agent, or Firm*—Flynn, Thiel, Boutell & Tanis

[57] ABSTRACT

A front jaw with a housing, in which is housed a release spring. The release spring loads a pull rod extending through the release spring, which pull rod acts onto the shorter lever arms of two toggle levers through a release plate , which toggle levers are pivotal about vertical axes on a bearing part and the longer lever arms of which toggle levers are designed as sole holders. The bearing part has a through opening for the pull rod and has a front support surface resting at least partially on a rear cross wall of the housing. The rear cross wall of thee housing has a first section extending rearwardly in a direction substantially along a longitudinal axis from an upper end thereof. The front support surface of the bearing part has upper and lower sections which are spaced in an elevational direction. The rear cross wall of the housing extends perpendicular to the longitudinal axis. The lower section and the upper section define an obtuse angle with one another, and a rearwardly and downwardly inclined section extends from the upper section of the front support surface.

2 Claims, 3 Drawing Sheets

FRONT JAW

FIELD OF THE INVENTION

The invention relates to a front jaw.

BACKGROUND OF THE INVENTION

Such a front jaw is described, for example, in EP-A2 0 408 855. In this known solution, both the relief of the toggle levers during upwardly acting forces and also the release movement of the jaw during a backward twisting fall is accomplished by a tilting of a bearing part relative to the jaw housing. The sole down-holding means is adapted to the respective shoe sole thickness by moving the bearing part along the rear crosswall of the jaw housing, with additional sloped surfaces being provided for this purpose on the housing and bearing part.

This solution is by all means practical, however, friction occurs inevitably at the contact surfaces during movement of these structural parts.

A slightly different front jaw is known from DE-OS 37 34 492, in which the sole holder is adjusted and relieved also by a movement, namely along a sloped surface of the housing. The already abovementioned disadvantage is thereby created.

An object of the invention is to bring help mere and to provide, in a front jaw of the abovementioned type, a mechanism for facilitating an automatic adaptation of the front jaw to the respective shoe sole thickness so that as little as possible friction will occur.

SUMMARY OF THE INVENTION

Due to the fact that with an essentially vertically extending rear crosswall on the housing, the frontwardly facing bearing surface of the bearing part has two adjacent sections in elevational direction, namely, a lower section and an upper section which define an obtuse angle with one another whereat a pivot edge is created and about which the bearing part can be pivoted to facilitate adaptation to the shoe sole.

The development enables, after utilizing the pivoting movement made possible by the pivot edge, a further pivoting of the bearing part for effecting a binding release.

BRIEF DESCRIPTION OF THE DRAWINGS

Further advantages, characteristics and details of the front jaw of the invention will now be described in greater detail in connection with the drawings, in which.

DETAILED DESCRIPTION

Figure 1:
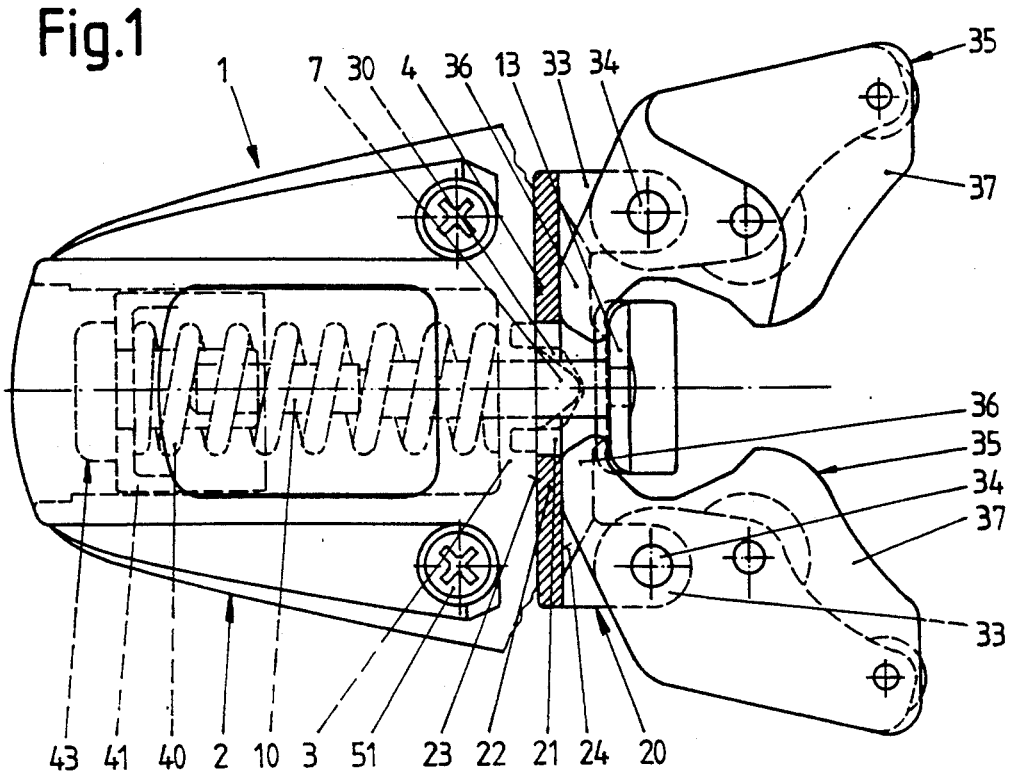
FIG. 1 is a partially sectioned elevational top view of the front jaw.
Figure 2:
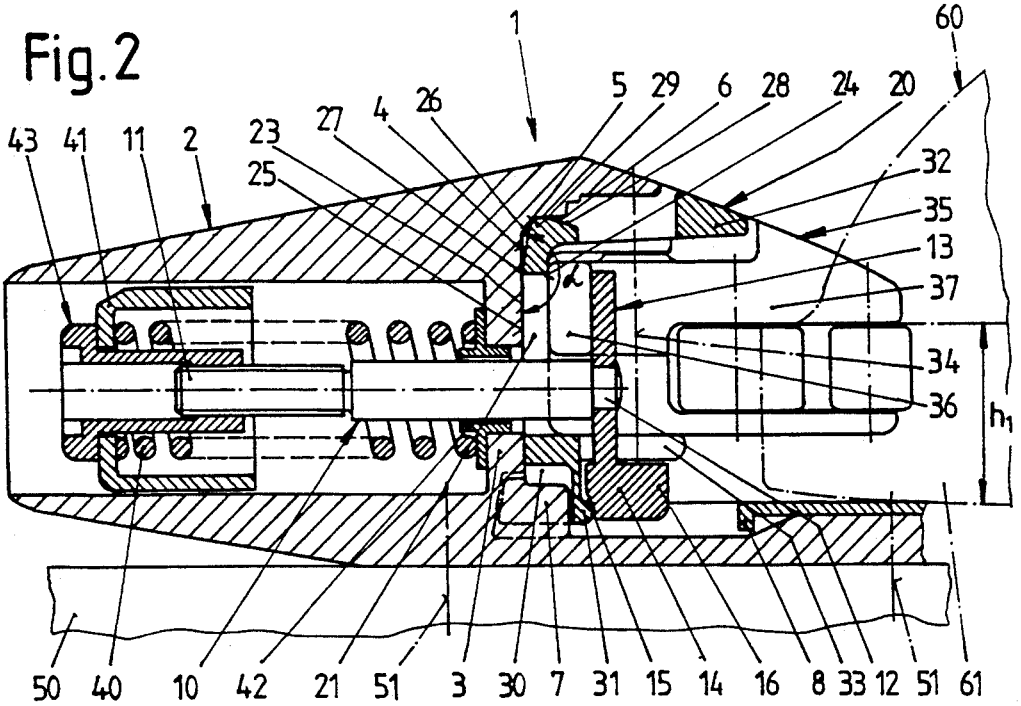
FIG. 2 is a longitudinal cross-sectional view of the front jaw in a position of the ski binding which is ready to be stepped into by an indicated ski shoe.
Figure 3:
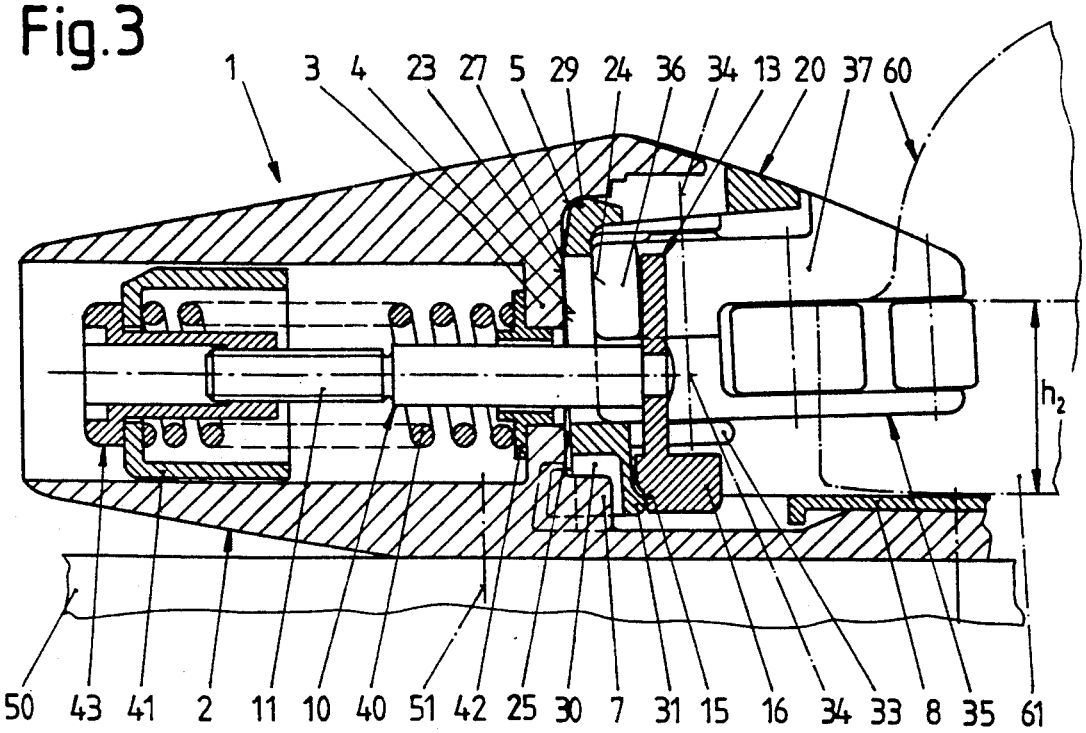
FIG. 3 is an illustration similar to FIG. 2, with an inserted ski shoe, with a thick sole.

FIGS. 1 and 2 illustrate a front jaw 1 embodying the invention in a position in which it is ready to be stepped into. It has a housing 2 which is fastened to a ski 50 by means of screws 51, which are only schematically indicated. A release spring 40 is housed in the housing 2, the initial tension of which release spring can be adjusted in a conventional manner by an adjusting device 43. The release spring 40 is arranged between a spring plate 41 and, with the interpositioning of a support sleeve 42, a vertically extending rear crosswall 3 of the housing. A pull rod 10 extends in axial direction through the release spring 40, one end 11 thereof cooperating with the adjusting device 43 and an other end 12 being connected to an essentially vertically extending release plate 13. The release plate 13 has at its lower end 14 a control surface 15 facing toward the tip of the ski and a stop 16 pointing in direction of the shoe 60.

A first curved surface 5 is provided at the juncture of the top of the vertically extending rear crosswall 3 of the housing 2 and a horizontally rearwardly extending section 6. A bearing part 20 having a support wall 22 rests on the backside 4 of the rear crosswall 3 of the housing 2 in a position of the front jaw 1 ready to be stepped into. The bearing part 20 has, viewed from the rear, a framelike shape, namely it has a through opening 21 for the pull rod 10, and has, viewed in a side view, the approximate shape of a C. The vertically extending section of the C is formed by the support wall 22 and is equipped with a frontwardly facing bearing surface 23 and a rearwardly facing bearing surface 24. Two, only schematically indicated, axes 34 for toggle levers 35 are symmetrically arranged with respect to the longitudinal center axis of the front jaw 2 in the upper and lower legs 32, 33 of the C. The shorter lever arms 36 of the two toggle levers 35 are supported on the one side thereof on the release plate 13 and on the other side thereof on the rearwardly facing bearing surface 24 of the bearing part 20. The longer lever arms of the toggle levers 35 are constructed as sole holders 37 to rest on the sole 61 of the ski shoe 60 only schematically indicated in the drawing. The frontwardly facing bearing surface 23 of the bearing part 20 has two sections abutting in elevational direction, viewed in the position of the front jaw 2 ready to be stepped into, with a lower section 25 thereof resting on the backside 4 of the rear crosswall 3 of the housing 2. The upper section 26 defines an obtuse angle $\alpha$ with the lower section 25. The bearing part 20 has an edge 27 defining a pivot between the upper section 26 and the lower section 25. The upper leg 32 of the bearing part 20 is equipped with a rearwardly and downwardly inclined surface 28 in the area of the longitudinal center axis. The transition between the upper section 26 of the frontwardly facing bearing surface 23 and the rearwardly and downwardly inclined surface 28 is designed as a further curved surface 29. The bearing part 20 is designed fork-shaped in the top view in its lower section in the area of the longitudinal center axis and has a forwardly open recess 30 and a rearwardly directed projection 31, which will yet be described in greater detail. A suitable pointed projection 7 on the housing 2 is received in the recess 30. A path-defining means 8 facing the stop 16 on the release plate 13 is furthermore arranged on the housing 2.

When a ski shoe 60 is inserted into the ski binding, the sole 61 of which has an average thickness ($h_1$) the lower section 25 of the frontwardly facing bearing surface 23 of the bearing part 20 rests flat against the backside 4 of the rear crosswall 3 of the housing 2, and a curved surface 29 on the bearing part 20 remains in continuous contact with the horizontally rearwardly extending section 6 of the housing 2.

If the sole 61 of the ski shoe 60 has a greater thickness ($h_2$), the bearing part 20 pivots lightly counterclockwise about the pivot edge 27. This causes the release spring 40 to become slightly compressed. Thus, the bearing part 20 with the toggle levers 35 thereon will automatically return to the initial position thereof after the removal of the ski shoe 60 and it will be possible, without any additional manipulation, to selectively use ski shoes with a thicker or thinner sole.

Figure 4:
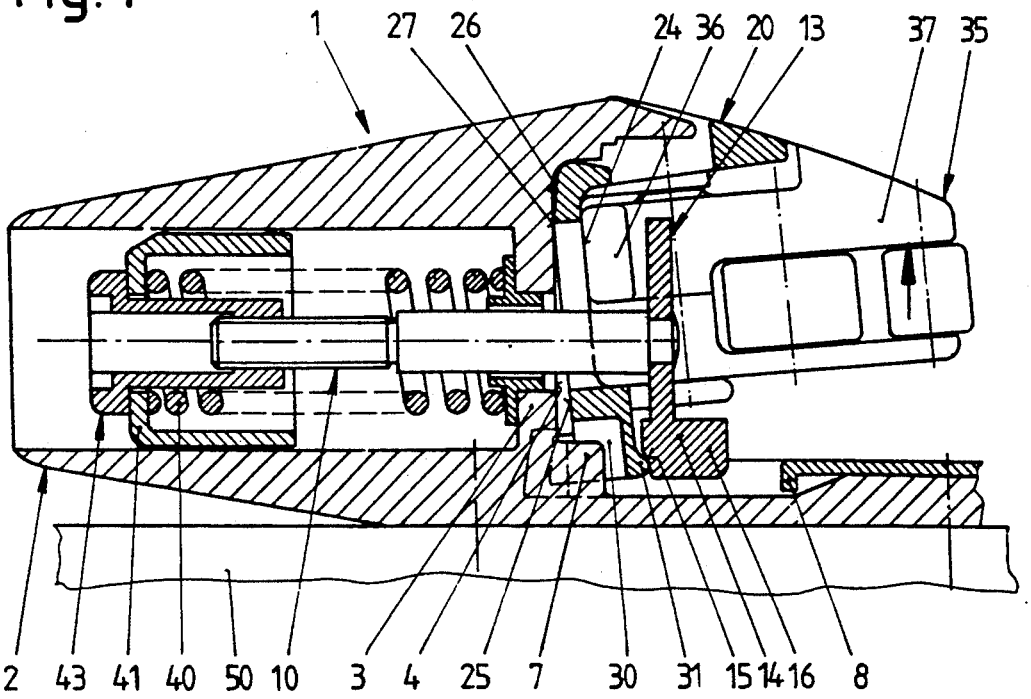
FIG. 4 is the same view with a slightly more swiveled sole holder.
Figure 5:
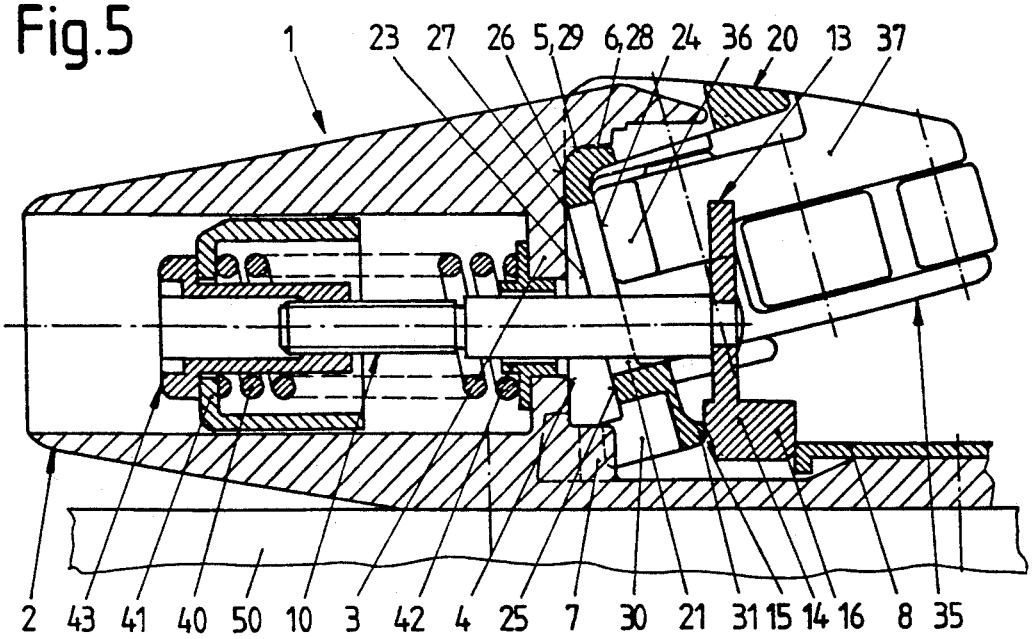
FIG. 5 shows the binding with the sole holder being pivoted to its maximum extent.
Figure 6:
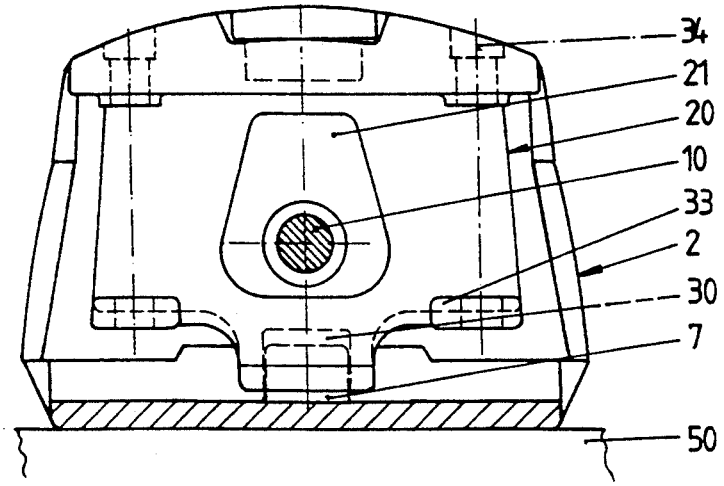
FIGS. 6 and 7 are partially sectioned rear views, with the binding in FIG. 6 being shown in an at-rest position and in FIG. 7 laterally upwardly swiveled.
Figure 7:
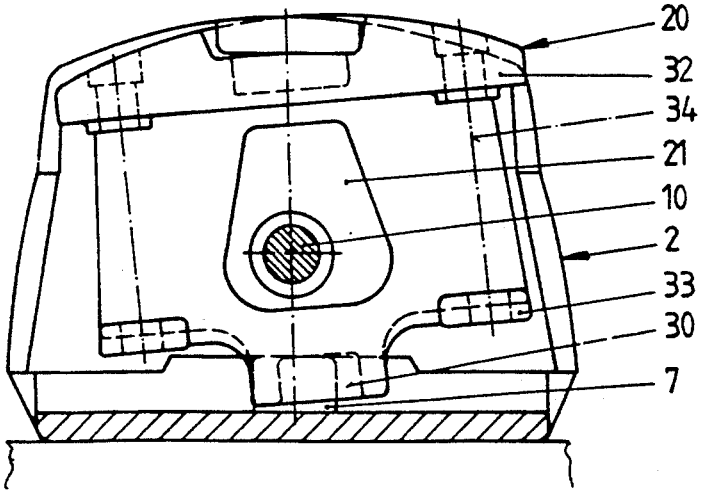

FIGS. 4 and 5 illustrate how the bearing part 20 and the toggle levers 35 are pivoted during an upwardly directed increased force, for example, during a backward fall or a backward twisting fall. The bearing part 20 continues to be pivoted about the pivot edge 27 against the force of the release spring 40. FIG. 4 illustrates that the release plate 13 is thereby released from engagement with the shorter lever arms 36 of the toggle levers 35. This enables, first, a force-free pivoting of the toggle levers 35 to facilitate a lateral release. Furthermore, the tapered and pointed design of the projection 7 permits in cooperation with the recess 30 a lateral swiveling of the bearing part 20 (see FIGS. 6 and 7). An excessive upward pivoting of the sole holder 37 to thus cause an undesired release of the ski shoe, is prevented by the swivel path of the bearing part 20 being limited by the stop 16 of the release plate 13 striking the path-defining means 8.

The embodiments of the invention in which an exclusive property or privilege is claimed are defined as follows:

1. A front jaw for a ski binding including a housing adapted to be fastened to a ski and having a rear cross wall extending transverse to a longitudinal axis of the ski, the rear cross wall having a first section extending rearwardly in a direction substantially along the longitudinal axis from an upper end thereof and a central bore through the rear cross wall, an abutment means on a front surface of the rear cross wall, a release spring housed in the housing and having an end thereof abutting the abutment means, an elongated pull rod extending through the release spring within the housing, the release spring being oriented to urge the pull rod along the longitudinal axis, a release plate coupled to one end of the pull rod, two toggle levers each having a short lever arm and a long lever arm, the release plate operatively coupling the pull rod to the short lever arms and the long lever arms engaging a front end of a sole of a ski boot, and a bearing part having a through opening for the pull rod and a front support surface resting at least partially against a rear surface of the rear cross wall, the toggle levers being arranged pivotally on the bearing part, the front support surface of the bearing part including a second section and a third section extending rearwardly and upwardly inclined from an upper end of the second section, the second and third sections defining a pivot axis and an obtuse angle therebetween, the improvement wherein the rear surface and the third section diverge from the pivot axis and thereabove, and wherein a fourth section is provided which extends rearwardly and downwardly from an upper extend of the third section inclined with respect to the longitudinal axis defining a surface which remains in continuous contact with a horizontal rearwardly extending section within the housing.

2. The ski binding according to claim 1, wherein the first section is connected to the rear surface of the rear cross wall through a first curved surface, wherein the bearing part further includes a second curved surface connecting the third section to the fourth section, and wherein the third and fourth sections define an acute angle therebetween.

* * * * *